US010438542B2

(12) United States Patent
Li et al.

(10) Patent No.: US 10,438,542 B2
(45) Date of Patent: Oct. 8, 2019

(54) DETECTION CIRCUIT, DETECTION METHOD AND PIXEL DRIVING CIRCUIT

(71) Applicant: BOE Technology Group Co., Ltd., Beijing (CN)

(72) Inventors: Yongqian Li, Beijing (CN); Longyan Wang, Beijing (CN); Cuili Gai, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 243 days.

(21) Appl. No.: 15/518,335

(22) PCT Filed: Sep. 30, 2015

(86) PCT No.: PCT/CN2015/091183
§ 371 (c)(1),
(2) Date: Apr. 11, 2017

(87) PCT Pub. No.: WO2017/000407
PCT Pub. Date: Jan. 5, 2017

(65) Prior Publication Data

US 2017/0309231 A1 Oct. 26, 2017

(30) Foreign Application Priority Data

Jun. 29, 2015 (CN) ..... 2015 1 0370182

(51) Int. Cl.
*G09G 3/3291* (2016.01)
*G09G 3/3225* (2016.01)
*G09G 3/3233* (2016.01)

(52) U.S. Cl.
CPC ..... *G09G 3/3291* (2013.01); *G09G 3/3225* (2013.01); *G09G 3/3233* (2013.01);
(Continued)

(58) Field of Classification Search
CPC ... G09G 3/3291; G09G 3/3225; G09G 3/3233
See application file for complete search history.

(56) References Cited

U.S. PATENT DOCUMENTS 8,558,825 B2 10/2013 Bae et al.
8,988,329 B2 3/2015 Yoon et al.
(Continued)

FOREIGN PATENT DOCUMENTS

CN 101968947 A 2/2011
CN 102074189 A 5/2011
(Continued)

OTHER PUBLICATIONS

Third Office Action for Chinese Patent Application No. 201510370182.6, dated May 3, 2017, 13 pages.
(Continued)

*Primary Examiner* — Sardis F Azongha
(74) *Attorney, Agent, or Firm* — Westman, Champlin & Koehler, P.A.

(57) ABSTRACT

A detection circuit, a detection method and a pixel driving circuit are disclosed in the embodiments of the present disclosure. The detection circuit comprises a first detection unit, a second detection unit, a load unit, a light emitting device and a driving unit. The first detection module connected to the driving unit and the load unit. The second detection unit is connected to the light emitting device and the load unit.

10 Claims, 5 Drawing Sheets

(52) U.S. Cl.
CPC ..... *G09G 2300/0852* (2013.01); *G09G 2300/0861* (2013.01); *G09G 2320/029* (2013.01); *G09G 2320/045* (2013.01)

(56) References Cited

U.S. PATENT DOCUMENTS

| | | | | |
|---|---|---|---|---|
| 9,430,968 | B2 | 8/2016 | Kishi et al. | |
| 9,548,020 | B2 * | 1/2017 | Kim | G09G 3/3233 |
| 2008/0048951 | A1 | 2/2008 | Naugler, Jr. et al. | |
| 2013/0050292 | A1 * | 2/2013 | Mizukoshi | G09G 3/3291 345/690 |
| 2013/0057532 | A1 | 3/2013 | Lee et al. | |
| 2013/0147690 | A1 * | 6/2013 | Kim | G09G 3/3233 345/76 |
| 2013/0162617 | A1 | 6/2013 | Yoon et al. | |
| 2016/0125811 | A1 * | 5/2016 | Park | G09G 3/3258 345/694 |
| 2017/0053590 | A1 | 2/2017 | Song et al. | |

FOREIGN PATENT DOCUMENTS

| | | | |
|---|---|---|---|
| CN | 103177685 | A | 6/2013 |
| CN | 104393024 | A | 3/2015 |
| CN | 104700761 | A | 6/2015 |
| CN | 104882100 | A | 9/2015 |
| TW | 201506884 | A | 2/2015 |

OTHER PUBLICATIONS

Fourth Office Action, including Search Report, for Chinese Patent Application No. 201510370182.6, dated Oct. 23, 2017, 12 pages.

International Search Report (English translation of International Search Report Only) and Written Opinion of International Application No. PCT/CN2015/091183, dated Apr. 5, 2016, 10 pages.

English translation of Box No. V of the Written Opinion for the International Searching Authority for International Application No. PCT/CN2015/091183, 2 pages.

First Office Action, including Search Report, for Chinese Patent Application No. 201510370182.6, dated Nov. 22, 2016, 12 pages.

Second Office Action, including Search Report, for Chinese Patent Application No. 201510370182.6, dated Feb. 23, 2017, 12 pages.

* cited by examiner

DETECTION CIRCUIT, DETECTION METHOD AND PIXEL DRIVING CIRCUIT

CROSS-REFERENCE TO RELATED APPLICATION(S)

This application is a Section 371 National Stage Application of PCT International Application No. PCT/CN2015/091183, filed on Sep. 30, 2015, which published as WO 2017/000407 A1, on Jan. 5, 2017, which claims priority to the Chinese Patent Application No. 201510370182.6, filed on Jun. 29, 2015, which is incorporated herein by reference.

TECHNICAL FIELD

The embodiments of the present disclosure relate to the field of display technology, and more particularly, to a detection circuit, a detection method and a pixel driving circuit.

BACKGROUND

With the development of display technology, Organic Light-Emitting Diode (OLED) display apparatuses are more and more widely used. An OLED display apparatus may comprise a plurality of pixels and a pixel driving circuit for driving the pixels, wherein each pixel comprises an OLED, and the pixel driving circuit may comprise Thin Film Transistors (TFT for short) and capacitors.

In the OLED display device, as specific factors of the TFT corresponding to various pixels, such as threshold voltages Vth, mobility, parasitic capacitances, and channel widths/lengths etc., are different, there is a problem of non-uniformity of luminance for the OLED display apparatus at the time of display.

However, there is only a circuit in the conventional technology which can detect process parameters of the TFT, but there is no circuit which can not only detect the characteristic parameters of the TFT but also can detect the characteristic parameters of the OLED.

SUMMARY

Embodiments of the present disclosure provides a detection circuit, a detection method and a pixel driving circuit for detecting characteristic parameters of a driving unit and characteristic parameters of a light emitting device.

According to an aspect of the embodiments of the present disclosure, there is provided a detection circuit, comprising: a first detection unit, a second detection unit, a load unit, a light emitting device and a driving unit, wherein the first detection unit is connected to the driving unit and the load unit, and the second detection unit is connected to the light emitting device and the load unit.

As an example, the first detection unit comprises a first switch transistor, a second switch transistor, a third switch transistor and a storage capacitor, and the driving unit comprises a driving transistor, wherein, the first switch transistor has a control electrode connected to a first control line, a first electrode connected to a data line and the load unit, and a second electrode connected to a second electrode of the third switch transistor and a first terminal of the storage capacitor;

the second switch transistor has a control electrode connected to a second control line, a first electrode connected to a reference power source, and a second electrode connected to a control electrode of the driving transistor and a second terminal of the storage capacitor;

the third switch transistor has a control electrode connected to a third control line, a first electrode connected to a first power source, and a second electrode connected to a first electrode of the driving transistor and the first terminal of the storage capacitor; and the driving transistor has the control electrode connected to the second terminal of the storage capacitor and a second electrode connected to a first electrode of the light emitting device.

As an example, the second detection unit comprises a fourth switch transistor having a control electrode connected to a fourth control line, a first electrode connected to the data line and the first terminal of the load unit, and a second electrode connected to the first electrode of the light emitting device.

As an example, the light emitting device has a second electrode connected to a second power source.

As an example, the load unit comprises a load capacitor.

As an example, the characteristic parameters of the driving unit comprise at least one of a threshold voltage and electron mobility, and the characteristic parameters of the load unit comprise at least one of a threshold voltage and electron mobility.

As an example, in a pre-charging phase, a pre-charging voltage is supplied to the load unit through the data line; in a first detection phase, the load unit is discharged through the first detection unit and the driving unit, so as to detect the characteristic parameters of the driving unit; and in a second detection phase, the load unit is discharged through the second detection unit and the light emitting device, so as to detect the characteristic parameters of the light emitting device.

According to another aspect of the embodiments of the present disclosure, there is provided a pixel driving circuit comprising the detection circuit described above and a pixel compensation circuit, wherein the pixel compensation circuit is configured to compensate for the driving unit according to the characteristic parameters of the driving unit, and compensate for the light emitting device according to the characteristic parameters of the light emitting device.

According to another aspect of the embodiments of the present disclosure, there is provided a detection method for use in the detection circuit according to the embodiments of the present disclosure, wherein the detection circuit comprises a first detection unit, a second detection unit, a load unit, a light emitting device and a driving unit, wherein the first detection unit is connected to the driving unit and the load unit, and the second detection unit is connected to the light emitting device and the load unit, the detection method comprising:

in a pre-charging phase, supplying a pre-charging voltage to the load unit through a data line;

in a first detection phase, discharging the load unit through the first detection unit and the driving unit, so as to detect characteristic parameters of the driving unit; and in a second detection phase, discharging the load unit through the second detection unit and the light emitting device, so as to detect characteristic parameters of the light emitting device.

As an example, the second detection unit comprises a fourth switch transistor having a control electrode connected to a fourth control line, a first electrode connected to the data line and a first terminal of the load unit, and a second electrode connected to a first electrode of the light emitting device; and discharging the load unit through the second detection unit and the light emitting device comprises: turning on the fourth switch transistor and discharging the load unit through the fourth switch transistor and the light emitting device.

As an example, the load unit comprises a load capacitor.

As an example, the driving unit comprises a driving transistor.

BRIEF DESCRIPTION OF THE DRAWINGS

The embodiments of the present disclosure will now be described in detail with reference to the accompanying drawings, in which.

DETAILED DESCRIPTION

In order to enable those skilled in the art to better understand the technical solutions according to the embodiments of the present disclosure, the detection circuit, the detection method, and the pixel circuit according to the embodiments of the present disclosure will be described in detail below in conjunction with the accompanying drawings.

Figure 1:
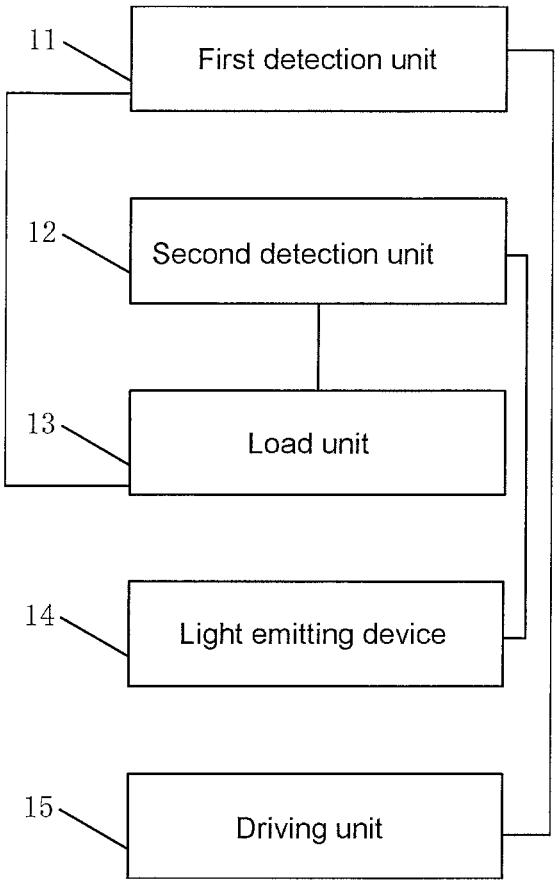
FIG. 1 is a structural diagram of a detection circuit according to a first embodiment of the present disclosure.

FIG. 1 is a structural diagram of a detection circuit according to a first embodiment of the present disclosure. As shown in FIG. 1, the detection circuit may comprise a first detection unit 11, a second detection unit 12, a load unit 13, a light emitting device 14 and a driving unit 15, wherein the first detection unit 11 is connected to the driving unit 15 and the load unit 13, and the second detection unit 12 is connected to the light emitting device 14 and the load unit 13.

In a pre-charging phase, a pre-charging voltage is supplied to the load unit 13 through a data line DL; in a first detection phase, the load unit 13 is discharged through the first detection unit 11 and the driving unit 15, so as to detect characteristic parameters of the driving unit 15; and in a second detection phase, the load unit 13 is discharged through the second detection unit 12 and the light emitting device 14, so as to detect characteristic parameters of the light emitting device 14.

In the present embodiment, the characteristic parameters of the driving unit 15 may comprise at least one of a threshold voltage and electron mobility etc. The load unit 13 is discharged through the first detection unit 11, the driving unit 15 and the light emitting device 14, so that an external detection circuit detects the characteristic parameters of the driving unit 15.

In the present embodiment, the characteristic parameters of the load unit 13 may comprise at least one of a threshold voltage and electron mobility etc. The load unit 13 is discharged through the second detection unit 12 and the light emitting device 14, so that the external detection circuit detects the characteristic parameters of the light emitting device 14.

In the detection circuit according to the present embodiment, the first detection unit is connected to the driving unit and the load unit, the second detection unit is connected to the light emitting device and the load unit, and the driving unit is connected to the light emitting device, so that the characteristic parameters of the driving unit and the characteristic parameters of the light emitting device can be detected. In the present embodiment, functions of a data line and a detection line are combined by using the data line as a detection line without further setting a detection line, thereby reducing the complexity of the circuit and the manufacturing cost.

Figure 2:
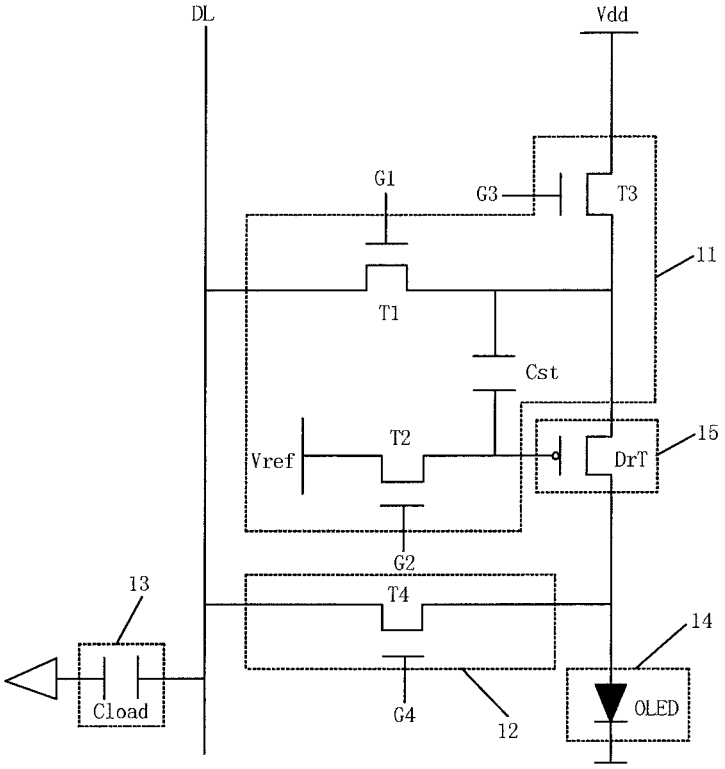
FIG. 2 is a structural diagram of a detection circuit according to a second embodiment of the present disclosure.

FIG. 2 is a structural diagram of a detection circuit according to a second embodiment of the present disclosure. As shown in FIG. 2, the detection circuit may comprise a first detection unit 11, a second detection unit 12, a load unit 13, a light emitting device 14 and a driving unit 15, wherein the first detection unit 11 is connected to the driving unit 15 and the load unit 13, and the second detection unit 12 is connected to the light emitting device 14 and the load unit 13. In a pre-charging phase, a pre-charging voltage is supplied to the load unit 13 through a data line DL; in a first detection phase, the load unit 13 is discharged through the first detection unit 11 and the driving unit 15, so as to detect characteristic parameters of the driving unit 15; and in a second detection phase, the load unit 13 is discharged through the second detection unit 12 and the light emitting device 14, so as to detect characteristic parameters of the light emitting device 14.

Further, the driving unit 15 is also connected to the light emitting device 14.

In the present embodiment, the characteristic parameters of the driving unit 15 may comprise at least one of a threshold voltage and electron mobility etc. The driving unit 15 is discharged through the first detection unit 11, the driving unit 15 and the light emitting device 14, so that an external detection circuit detects the characteristic parameters of the driving unit 15.

In the present embodiment, the characteristic parameters of the load unit 13 may comprise at least one of a threshold voltage and electron mobility etc. The load unit 13 is discharged through the second detection unit 12 and the light emitting device 14, so that the external detection circuit detects the characteristic parameters of the light emitting device 14.

In the present embodiment, as shown in FIG. 2, the first detection unit 11 may comprise a first switch transistor T1, a second switch transistor T2, a third switch transistor T3, and a storage capacitor Cst, and the driving unit 15 may comprise a driving transistor DrT. The first switch transistor T1 has a control electrode connected to a first control line G1, a first electrode connected to the data line DL and the load unit 13, and a second electrode connected to a second electrode of the third switch transistor T3 and a first terminal of the storage capacitor Cst; the second switch transistor T2 has a control electrode connected to a second control line G2, a first electrode connected to a reference power source Ref, and a second electrode connected to a control electrode of the driving transistor DrT and a second terminal of the storage capacitor Cst; the third switch transistor T3 has a control electrode connected to a third control line G3, a first electrode connected to a first power source Vdd, and the second electrode connected to a first electrode of the driving transistor DrT and the first terminal of the storage capacitor Cst; and the driving transistor has the control electrode connected to the second terminal of the storage capacitor Cst and a second electrode connected to a first electrode of the light emitting device 14.

In the present embodiment, the second detection unit 12 comprises a fourth switch transistor T4 having a control electrode connected to a fourth control line G4, a first electrode connected to the data line DL and a first terminal of the load unit 13, and a second electrode connected to the first electrode of the light emitting device 14. In the pre-charging phase, the fourth switch transistor T4 is turned off; in the first detection phase, the fourth switch transistor T4 is turned off; and in the second detection phase, the fourth switch transistor T4 is turned on, and the load unit 13 is discharged through the fourth switch transistor T4 and the light emitting device 14, so as to detect the characteristic parameters of the light emitting device 14.

In the present embodiment, a second electrode of the light emitting device 14 is connected to a second power source Vss. For example, the first electrode is an anode and the second electrode is a cathode.

In the present embodiment, a second terminal of the load unit 13 is grounded or is connected to a voltage supply line, which is a stable voltage supply line. The load unit 13 comprises a load capacitance Cload.

In the present embodiment, the light emitting device 14 comprises an OLED, and the first switch transistor T1, the first switch transistor T2, the third switch transistor T3, the fourth switch transistor T4, and the driving transistor DrT are TFTs. In the present embodiment, for example, the driving transistor DrT is a P-type TFT.

The operation principle of the detection circuit according to the present embodiment will be described in detail below with reference to FIGS. 3 to 5.

Figure 3:
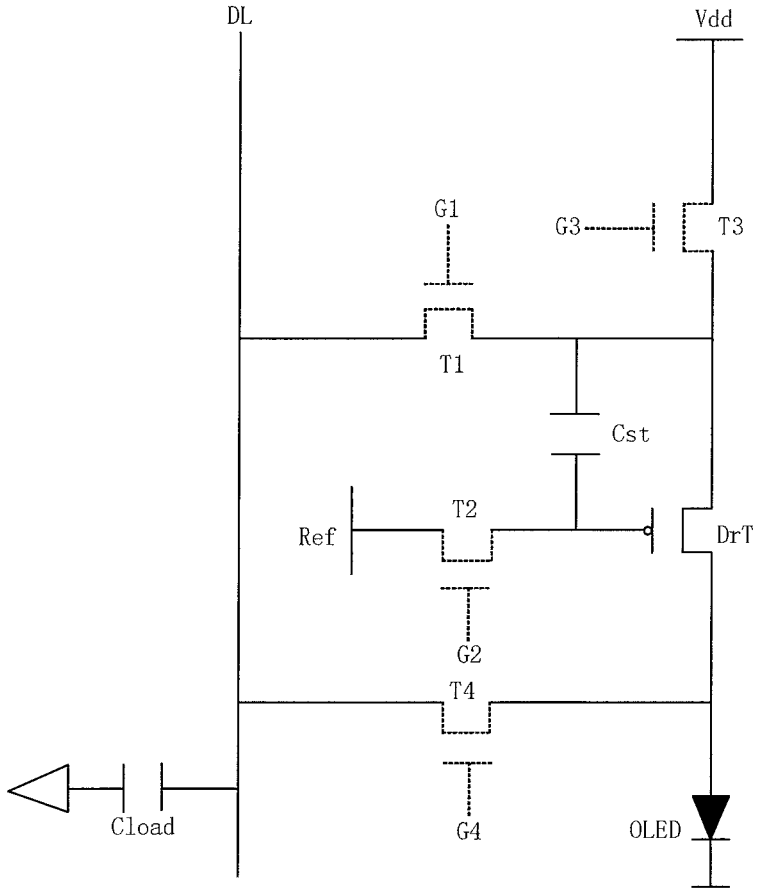
FIG. 3 is an equivalent circuit diagram of the detection circuit in a pre-charging phase according to the second embodiment.

FIG. 3 is an equivalent circuit diagram of a detection circuit in the pre-charging phase according to the second embodiment. As shown in FIG. 3, in the pre-charging phase, a first control signal is output to the first switch transistor T1 through the first control line G1 so that the first switch transistor T1 is turned off and the first control signal is at a low level at this time; a second control signal is output to the second switch transistor T2 through the second control line G2 so that the second switch transistor T2 is turned off and the second control signal is at a low level at this time; a third control signal is output to the third switch transistor T3 through the third control line G3 so that the third switch transistor T3 is turned off and the third control signal is at a low level at the same time; and a fourth control signal is output to the fourth switch transistor T4 through the fourth control line G4 so that the fourth switch transistor T4 is turned off and the fourth control signal is at a low level at the same time. A pre-charging voltage Vpre is supplied to the load capacitance Cload through the data line DL to charge the load capacitance Cload. The load capacitance Cload may be maintained at the pre-charging voltage Vpre on the data line DL.

Figure 4:
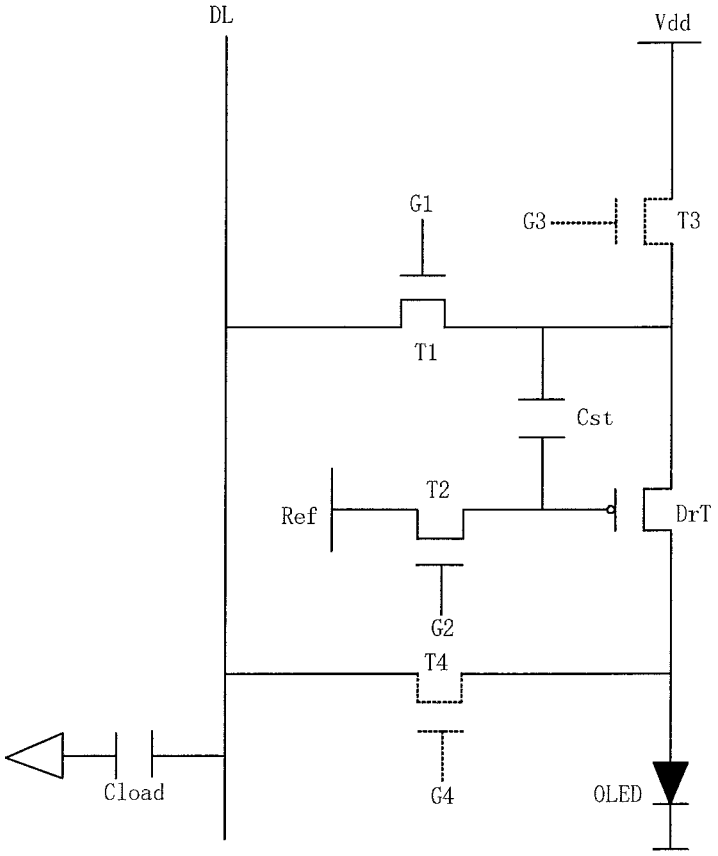
FIG. 4 is an equivalent circuit diagram of the detection circuit in a first detection phase according to the second embodiment.

FIG. 4 is an equivalent circuit diagram of the detection circuit in the first detection phase according to the second embodiment. As shown in FIG. 4, in the first detection phase, a first control signal is output to the first switch transistor T1 through the first control line G1 so that the first switch transistor T1 is turned on, and the first control signal is at a high level at this time; a second control signal is output to the second switch transistor T2 through the second control line G2 so that the second switch transistor T2 is turned on, and the second control signal is at a high level at this time; a third control signal is output to the third switch transistor T3 through the third control line G3 so that the third switch transistor T3 is turned off, and the third control signal is at a low level at this time; and a fourth control signal is output to the fourth switch transistor T4 through the fourth control line G4 so that the fourth switch transistor T4 is turned off, and the fourth control signal is at a low level at this time. When the first switch transistor T1 is turned on, a pre-charging voltage Vpre is supplied to the first terminal of the storage capacitor Cst through the data line DL to charge the storage capacitor Cst, and at this time, a voltage at the first terminal of the storage capacitor Cst is Vpre; and when the second switch transistor T2 is turned on, a reference voltage Vref is supplied by the reference power source Ref to the second terminal of the storage capacitor Cst to charge the storage capacitor Cst, and at this time, a voltage at the second terminal of the storage capacitor Cst is Vref. As a voltage difference Vpre−Vref across the storage capacitor Cst is greater than a threshold voltage Vth of the driving transistor DrT, the driving transistor DrT is driven. At this time, the load capacitance Cload is discharged through the first switch transistor T1, the driving transistor DrT and the OLED until the voltage difference across the storage capacitor Cst is equal to the threshold voltage Vth of the driving transistor DrT, so as to detect the characteristic parameters of the driving transistor DrT. Specifically, when the voltage difference across the storage capacitor Cst is equal to the threshold voltage Vth of the driving transistor DrT, an external detection circuit measures a sensing voltage V1 on the data line DL, which is the voltage at the first terminal of the Cst. As the voltage at the second terminal of the Cst is the reference voltage Vref, the external detection circuit calculates the threshold voltage of the driving transistor DrT as V1−Vref; and the external detection circuit may calculate other characteristic parameters, for example, electron mobility, of the driving transistor DrT according to the sensing voltage V1.

Figure 5:
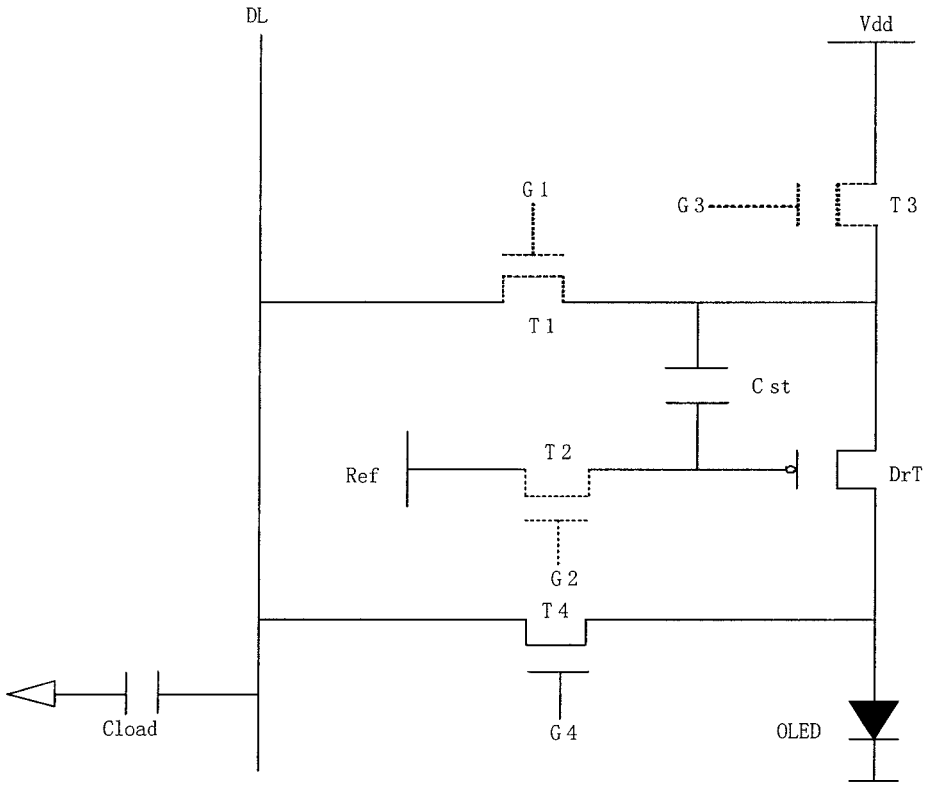
FIG. 5 is an equivalent circuit diagram of the detection circuit in a second detection phase according to the second embodiment.

FIG. 5 is an equivalent circuit diagram of the detection circuit in the second detection phase according to the second embodiment. As shown in FIG. 5, in the second detection phase, a first control signal is output to the first switch transistor T1 through the first control line G1 so that the first switch transistor T1 is turned off, and the first control signal is at a low level at this time; a second control signal is output to the second switch transistor T2 through the second control line G2 so that the second switch transistor T2 is turned off, and the second control signal is at a low level at this time; a third control signal is output to the third switch transistor T3 through the third control line G3 so that the third switch transistor T3 is turned off, and the third control signal is at a low level at this time; and a fourth control signal is output to the fourth switch transistor T4 through the fourth control line G4 so that the fourth switch transistor T4 is turned on, and the fourth control signal is at a high level at this time. After the fourth switch transistor T4 is turned on, the load capacitor Cload is discharged through the fourth switch transistor T4 and the OLED, so as to detect the characteristic parameters of the OLED. Specifically, when the load capacitance Cload is discharged through the fourth switch transistor T4 and the OLED, the external detection circuit measures a sensing voltage or a sensing current on the data line DL and calculates the characteristic parameters of the OLED according to the sensing voltage or the sensing current. Then, by analyzing a difference between characteristic parameters of OLEDs of different pixels, uniformity can be evaluated.

In the detection circuit according to the present embodiment, the load unit is discharged through the first detection unit and the driving unit to detect the characteristic parameters of the driving unit in the first detection phase, and the load unit is discharged through the second detection unit and the light emitting device to detect the characteristic parameters of the light emitting device in the second detection phase, so that in the present embodiment, not only the characteristic parameters of the driving unit but also the characteristic parameters of the light emitting device can be detected. In the present embodiment, functions of a data line and a detection line are combined by using the data line as a detection line without further setting a detection line, thereby reducing the complexity of the circuit and the manufacturing cost.

A third embodiment of the present disclosure provides a pixel driving circuit comprising a detection circuit and a pixel compensation circuit. The detection circuit may use the detection circuit according to the above-described first embodiment, which will not be specifically described here.

The pixel compensation circuit is configured to compensate for the driving unit according to the characteristic parameters of the driving unit and compensate for the light emitting device according to the characteristic parameters of the light emitting device.

In the pixel driving circuit according to the present embodiment, the first detection unit is connected to the driving unit and the load unit, and the second detection unit is connected to the light emitting device and the load unit, so that in the present embodiment, not only the characteristic parameters of the driving unit but also the characteristic parameters of the light emitting device can be detected. In the present embodiment, functions of a data line and a detection line are combined by using the data line as a detection line without further setting a detection line, thereby reducing the complexity of the circuit and the manufacturing cost.

The embodiments of the present disclosure provide a detection method for use in a detection circuit, wherein the detection circuit comprises a first detection unit, a second detection unit, a load unit, a light emitting device and a driving unit, wherein the first detection unit is connected to the driving unit and the load unit, and the second detection unit is connected to the light emitting device and the load unit.

The detection method may comprise the following steps.

In step 101, in a pre-charging phase, a pre-charging voltage is supplied to the load unit through a data line.

In step 102, in a first detection phase, the load unit is discharged through the first detection unit and the driving unit, so as to detect characteristic parameters of the driving unit.

In step 103, in a second detection phase, the load unit is discharged through the second detection unit and the light emitting device, so as to detect characteristic parameters of the light emitting device.

In the present embodiment, the second detection unit comprises a fourth switch transistor having a control electrode connected to a fourth control line, a first electrode connected to the data line and a first terminal of the load unit, and a second electrode connected to a first electrode of the light emitting device. The step 103 comprises:

turning on the fourth switch transistor and discharging the load unit through the fourth switch transistor and the light emitting device.

In the present embodiment, the load unit comprises a load capacitor, and the driving unit comprises a driving transistor.

The detection method according to the present embodiment can be realized by the detection circuit according to the above-described first embodiment or second embodiment. Specific description of the detection circuit can be known with reference to the above-described first embodiment or second embodiment, and will not be repeated here.

In the detection method according to the present embodiment, the load unit is discharged through the first detection unit and the driving unit to detect the characteristic parameters of the driving unit in the first detection phase, and the load unit is discharged through the second detection unit and the light emitting device to detect the characteristic parameters of the light emitting device in the second detection phase, so that in the present embodiment, not only the characteristic parameters of the driving unit but also the characteristic parameters of the light emitting device can be detected. In the present embodiment, functions of a data line and a detection line are combined by using the data line as a detection line without further setting a detection line, thereby reducing the complexity of the circuit and the manufacturing cost.

It is to be understood that the above implementations are merely illustrative embodiments used for illustrating the principle of the present disclosure, but the present disclosure is not limited thereto. It will be apparent to those skilled in the art that various changes and modifications can be made therein without departing from the spirit and essence of the present disclosure, and these changes and modifications are also considered to be within the protection scope of the present disclosure.

We claim:

1. A detection circuit, comprising:

a first detection unit;

a second detection unit;

a load capacitor;

a light emitting device; and a driving unit, wherein the first detection unit is connected to the driving unit and the load capacitor, and the second detection unit is connected to the light emitting device and the load capacitor;

wherein the first detection unit comprises a first switch transistor, a second switch transistor, a third switch transistor and a storage capacitor, and the driving unit comprises a driving transistor, wherein, the first switch transistor has a control electrode connected to a first control line, a first electrode connected to a data line and the load capacitor, and a second electrode connected to a second electrode of the third switch transistor and a first terminal of the storage capacitor; the second switch transistor has a control electrode connected to a second control line, a first electrode connected to a reference power source, and a second electrode connected to a control electrode of the driving transistor and a second terminal of the storage capacitor;

the third switch transistor has a control electrode connected to a third control line, a first electrode connected to a first power source, and a second electrode connected to a first electrode of the driving transistor and the first terminal of the storage capacitor; and the driving transistor has the control electrode connected to the second terminal of the storage capacitor and a second electrode connected to a first electrode of the light emitting device;

wherein the second detection unit comprises a fourth switch transistor having a control electrode connected to a fourth control line, a first electrode connected to the data line and the first terminal of the load capacitor, and a second electrode connected to the first electrode of the light emitting device.

2. The detection circuit according to claim 1, wherein the light emitting device has a second electrode connected to a second power source.

3. A pixel driving circuit comprising a pixel compensation circuit and the detection circuit according to claim 2, wherein the pixel compensation circuit is configured to compensate for the driving unit according to characteristic parameters of the driving unit, and compensate for the light emitting device according to characteristic parameters of the light emitting device.

4. The detection circuit according to claim 1, wherein in a pre-charging phase, a pre-charging voltage is supplied to the load capacitor through the data line; in a first detection phase, the load capacitor is discharged through the first detection unit and the driving unit, so as to detect characteristic parameters of the driving unit; and in a second detection phase, the load capacitor is discharged through the second detection unit and the light emitting device, so as to detect characteristic parameters of the light emitting device.

5. The detection circuit according to claim 4, wherein the characteristic parameters of the driving unit comprise at least one of a threshold voltage and electron mobility, and the characteristic parameters of the load capacitor comprise at least one of a threshold voltage and electron mobility.

6. A pixel driving circuit comprising a pixel compensation circuit and the detection circuit according to claim 5, wherein the pixel compensation circuit is configured to compensate for the driving unit according to the characteristic parameters of the driving unit, and compensate for the light emitting device according to the characteristic parameters of the light emitting device.

7. A pixel driving circuit comprising a pixel compensation circuit and the detection circuit according to claim 4, wherein the pixel compensation circuit is configured to compensate for the driving unit according to the characteristic parameters of the driving unit, and compensate for the light emitting device according to the characteristic parameters of the light emitting device.

8. A pixel driving circuit comprising a pixel compensation circuit and the detection circuit according to claim 1, wherein the pixel compensation circuit is configured to compensate for the driving unit according to characteristic parameters of the driving unit, and compensate for the light emitting device according to characteristic parameters of the light emitting device.

9. A detection method for use in the detection circuit according to claim 1, comprising:

in a pre-charging phase, supplying a pre-charging voltage to the load capacitor through a data line;

in a first detection phase, discharging the load capacitor through the first detection unit and the driving unit, so as to detect characteristic parameters of the driving unit; and in a second detection phase, discharging the load capacitor through the second detection unit and the light emitting device, so as to detect characteristic parameters of the light emitting device.

10. The detection method according to claim 9, wherein the second detection unit comprises a fourth switch transistor having a control electrode connected to a fourth control line, a first electrode connected to the data line and a first terminal of the load capacitor, and a second electrode connected to a first electrode of the light emitting device; and discharging the load capacitor through the second detection unit and the light emitting device comprises: turning on the fourth switch transistor and discharging the load unit through the fourth switch transistor and the light emitting device.

* * * * *